US010646909B2

(12) United States Patent
Fabianek

(10) Patent No.: US 10,646,909 B2
(45) **Date of Patent: *May 12, 2020**

(54) PLATE ROLL BENDING MACHINE WITH ROLL POSITION FEEDBACK CONTAINED WITHIN ROLL POSITIONING CYLINDER

(71) Applicant: Mega Manufacturing, Inc., Rockford, IL (US)

(72) Inventor: Michael Fabianek, Küssnacht (CH)

(73) Assignee: Mega Manufacturing, Inc., Rockford, IL (US)

( * ) Notice: Subject to any disclaimer, the term of this patent is extended or adjusted under 35 U.S.C. 154(b) by 742 days.

This patent is subject to a terminal disclaimer.

(21) Appl. No.: 15/349,687

(22) Filed: Nov. 11, 2016

(65) Prior Publication Data

US 2018/0133766 A1 May 17, 2018

(51) Int. Cl.
*B21D 5/14* (2006.01)
*B21D 5/00* (2006.01)

(52) U.S. Cl.
CPC ..... *B21D 5/14* (2013.01); *B21D 5/004* (2013.01)

(58) Field of Classification Search
CPC ..... B21D 5/14; B21D 5/146; B21D 5/002; B21D 5/004; B21B 2269/02; B21B 2269/04; B21B 2269/06
See application file for complete search history.

(56) References Cited

U.S. PATENT DOCUMENTS 4,796,449 A * 1/1989 Berne ..... B21D 5/14 72/8.3
5,187,959 A * 2/1993 Davi ..... B21D 5/14 72/10.6
2008/0098790 A1* 5/2008 Barinaga ..... B21D 5/14 72/374

* cited by examiner

*Primary Examiner* — Debra M Sullivan
(74) *Attorney, Agent, or Firm* — Leydig, Voit & Mayer, Ltd.

(57) ABSTRACT

A hydraulic roll bending machine includes a frame and a hydraulic cylinder supporting a bending roll such that extension or retraction of the rod changes a height of the bending roll relative to the frame. A hydraulic system includes a valve disposed to provide pressurized hydraulic fluid on at least one side of the hydraulic cylinder, and a controller operates to provide a command signal to a valve channeling hydraulic fluid from the hydraulic system to the cylinder. A sensor is integrated with the hydraulic cylinder, within the bore of the housing, and is disposed to sense a distance of the plunger relative to one end of the housing and provide a signal indicative of the distance to the controller.

20 Claims, 5 Drawing Sheets

PLATE ROLL BENDING MACHINE WITH ROLL POSITION FEEDBACK CONTAINED WITHIN ROLL POSITIONING CYLINDER

FIELD OF THE DISCLOSURE

The present disclosure generally relates to plate roll bending machines and, more particularly, to plate roll bending machines having hydraulic cylinders.

BACKGROUND OF THE DISCLOSURE

The present disclosure relates roll bending machines having three or four rolls, which are well known in the metal fabricating industry for rolling metal plate into cylinders, obrounds and cone shapes. A traditional roll bending machine 100 is shown in FIG. 1, which illustrates generally known arrangements for determining the position of hydraulic cylinders that operate to adjust a distance between bending rolls to, thus, adjust the bend radius of a bent plate. More specifically, the machine shown in FIG. 1 includes a rectilinear displacement transducer 101 associated with a hydraulic actuator 102 and associated with a moveable roller 103. The machine further includes string encoders 105 and 105' that are associated with respective hydraulic cylinders 106, 106' that are arranged to set or adjust a position of the machine's adjustable rolls 107 (only one visible). A rectilinear displacement transducer is a potentiometer that provides a voltage representative of position such that, based on the voltage from the transducer, a controller can infer or estimate the position of the hydraulic cylinder and, thus, the distance between rolls.

As is known, the output voltage of a rectilinear displacement transducer sensor will change with wear and scratches. In the particular application of a roll bending machine, lubricants and contaminants in the operating environment of the machine may also find their way into the sensor and, particularly, along a sliding interface between a resistive strip and a sensor tip, which will further degrade sensor life, accuracy and performance. Wear and scratches can also be caused by shock and vibration caused by rolling steel plates. Temperature is also a factor that can affect sensor performance and accuracy. Though contained within a housing and somewhat protected by mounting position, rectilinear displacement transducers used in roll bending machine applications are known to be prone to damage.

Similarly, string encoders, which are often also referred to as pull wire or pull rope encoders, are known to be relatively more reliable than potentiometer-based transducers in that they use a string 110 or 110' that can deflect or bend out of the way of a falling object. However, these strings are necessarily exposed such that a falling object hitting the string can cause a temporary change in feedback information and cause unwanted movement of the roll, which may cause a defect in the part being rolled. Resolution of string encoders is such that rolls can be leveled or set parallel to the gripping rolls within a tolerance of 1 mm.

BRIEF SUMMARY OF THE DISCLOSURE

In one aspect, the disclosure relates to a hydraulic roll bending machine, which includes a frame and a hydraulic cylinder. The hydraulic cylinder includes a housing forming a bore and a plunger slidably and sealably disposed within the bore of the housing, the plunger being connected to a rod extending past one end of the housing such that motion of the plunger within the bore of the housing causes the rod to extend or retract relative to the housing. The first end of the hydraulic cylinder is connected to the frame. A bending roll is rotatably connected to a second end of the hydraulic cylinder such that extension or retraction of the rod changes a height of the bending roll relative to the frame. A hydraulic system that includes a valve is disposed to provide pressurized hydraulic fluid on at least one side of the plunger within the bore of the housing. A controller operates to provide a command signal to the valve. A sensor is integrated with the hydraulic cylinder. The sensor is integrated within the bore of the housing and disposed to sense a distance of the plunger relative to one end of the housing and to provide a signal indicative of the distance to the controller.

In another aspect, the disclosure describes a hydraulic roll bending machine for bending metal plates. The machine includes a controller, and upper and lower gripping rolls rotatably and drivably mounted on a frame. A plate to be bent is arranged to pass between the upper and lower gripping rolls. A height of at least one of the upper and lower gripping rolls relative to the frame is adjustable by two cylinders. A bending roll is also rotatably mounted on the frame through two additional cylinders operating to adjust a height of first and second ends of the bending roll relative to the frame independently and in response to command signals provided by the controller. The controller is programmed and operates to adjust a position of each of the two cylinders and the two additional cylinders independently and based on a respective position signal provided by a sensor disposed in each of the two cylinders and the two additional cylinders. The respective position signal is provided by a respective sensor that is entirely disposed within the respective one of the two cylinders and the two additional cylinders.

DETAILED DESCRIPTION

The present disclosure generally relates to improvements in the positioning of metal working equipment using a sensor arrangement that is associated with a hydraulic actuator of the machine. The sensor arrangement is advantageously resistant to wear and to accuracy degradation because of vibration, debris and wear. A plate roll bending machine is shown and discussed herein for illustration.

Figure 1:
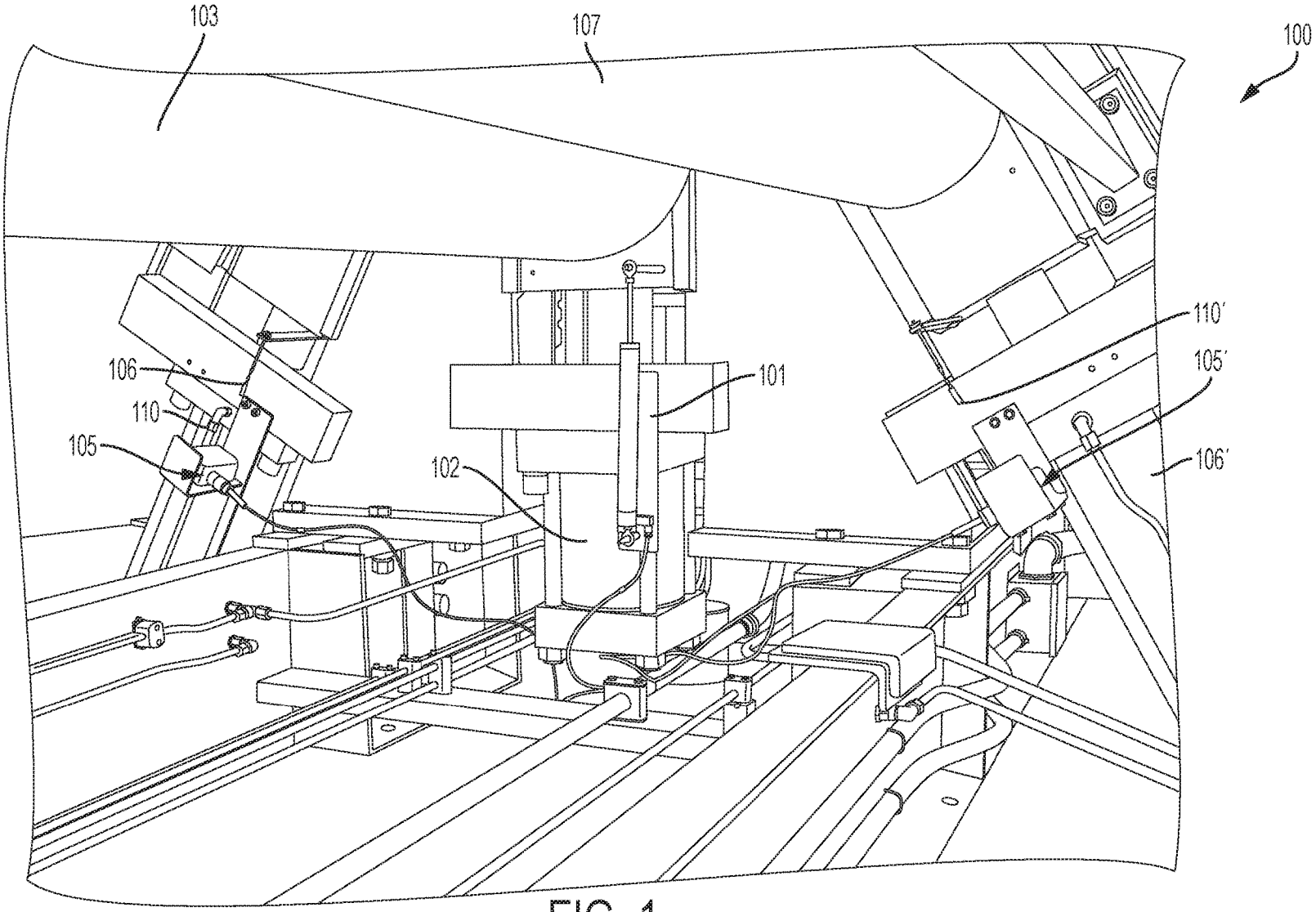
FIG. 1 PRIOR ART
FIG. 1 is partial view of a known plate roll bending machine.
Figure 2:
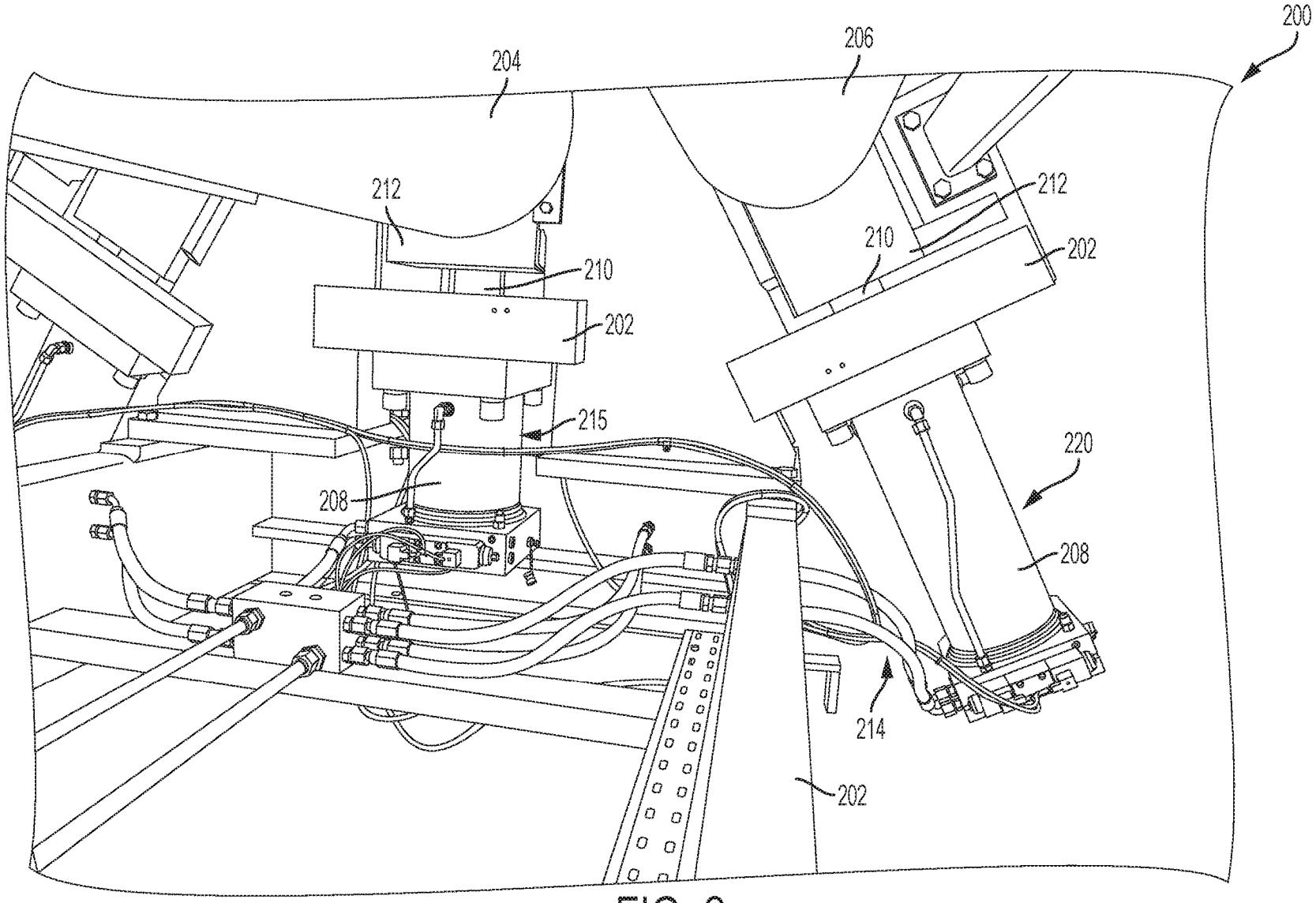
FIG. 2 is a partial view of a hydraulic, four roll bending machine in accordance with the disclosure.

Accordingly, a hydraulic roll bending machine 200 in accordance with the disclosure is shown in FIG. 2, from a close-up detailed perspective. The machine 200 is shown from different perspectives in FIGS. 5 and 6. The machine 200 includes a frame 202 that rotatably supports at least a first roller 204 and a second roller 206. A height of the first roller 204 relative to the frame 202 of the machine 200 is adjusted on either end of the roller by a respective hydraulic cylinder 215. Similarly, the second roller 206 has an adjustable height with respect to the frame 202 that is determined by a set of hydraulic cylinders 220. Each hydraulic cylinder 215 or 220 includes a bore or housing 208 that reciprocally houses a piston or plunger connected to a rod 210. The plunger separates the internal cavity of the housing into two variable volume chambers, which are selectively filled with pressurized hydraulic fluid to cause the plunger to move in one direction or the other. A block 212 connected to a free end of the rod 210 rotatably supports an end of the respective roller such that extension or retraction of the rod 210 relative to the housing causes the end of the roller to move relative to the frame 202, onto which the housing 208 of each respective actuator 215 and 220 is connected. Hydraulic lines 214 provide or remove fluid from the different chambers of the actuators 215 and 220 during operation.

Figure 4:
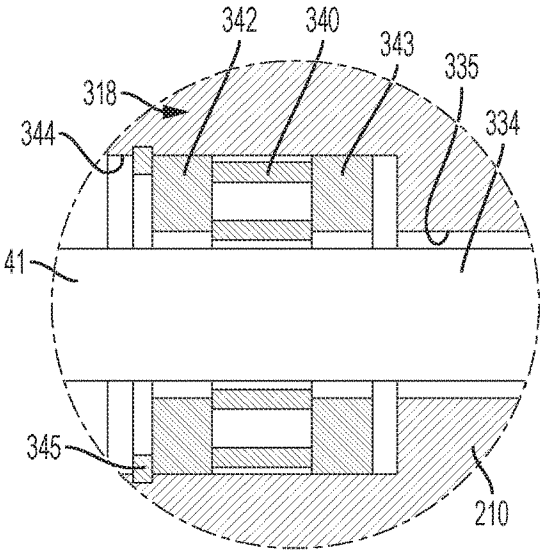
FIG. 4 is an enlarged detail view of FIG. 4.
Figure 3:
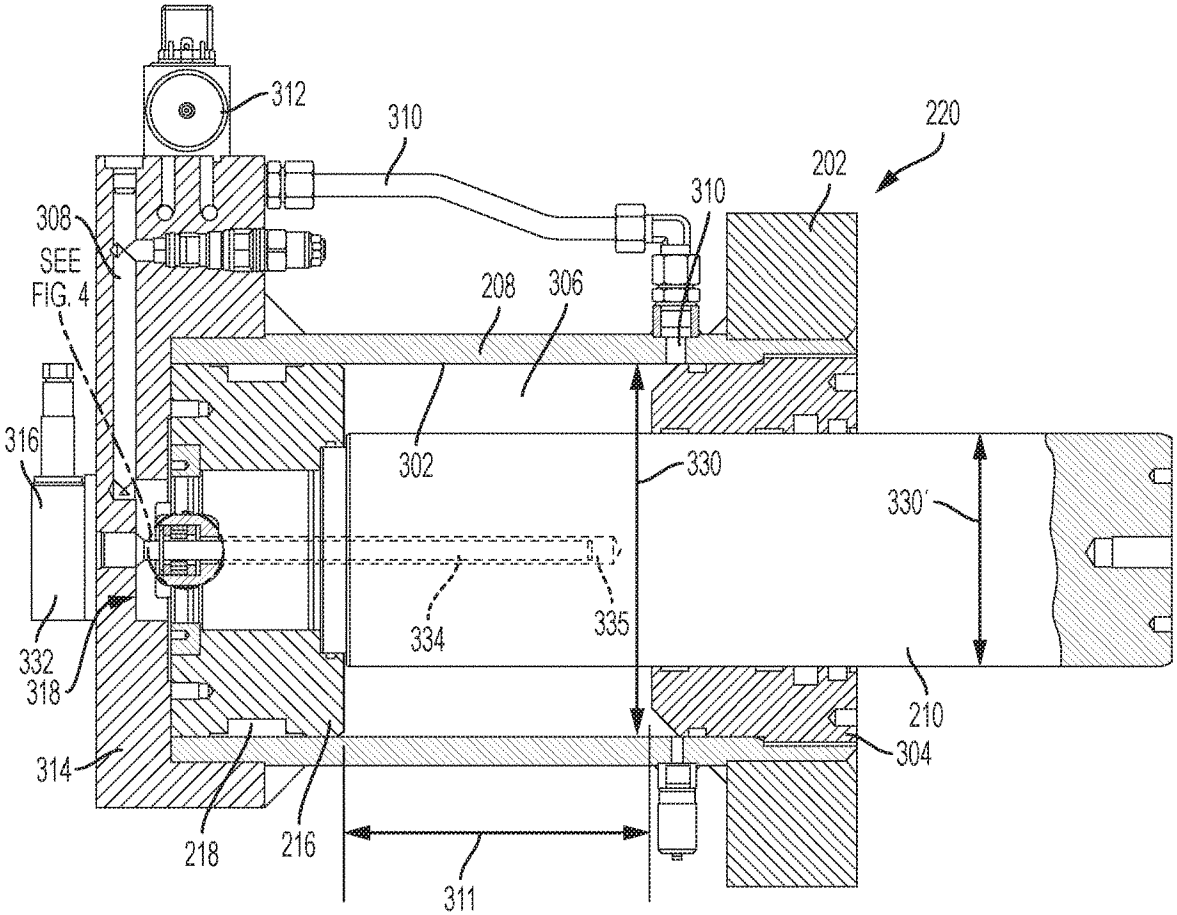
FIG. 3 is a sectioned roll positioning hydraulic cylinder containing a position feedback device in accordance with the disclosure.

A sectioned view through hydraulic cylinder 215, which is also representative of the structures of cylinder 220 but at different internal and external diameters and stroke length, is shown in FIG. 3 and in the enlarged detail of FIG. 4. In the illustrated embodiment, the cylinder 220 includes the plunger 216 that is slidably and sealably disposed within an internal bore 302 of the housing 208. As shown, the plunger 216 forms an external groove 218 that accommodates a seal (not shown) that sealably engages the inner surface of the bore 302 as the plunger 216 traverses its stroke 311. An outer end of the housing 208 is blocked by a header 304 having an annular shape that engages the inner surface of the bore 302 along an outer periphery and sealably and slidably accepts the post or rod 210 along an inner periphery.

As shown, the plunger 216 has an outer diameter 330 that is larger than diameter 330' of the rod 210 such that hydraulic pressure present on either side of the plunger 216 within the internal chamber 306 of the housing 208 will cause the plunger 216 to move and push or pull the rod 210 relative to the housing 208. Hydraulic oil or fluid is provided on either side of the plunger 216 by hydraulic passages 308 and 310, which are controlled by a valve 312. The valve 312 and its fluid connections to passages 308 and 310 are associated with a leader block 314.

In the illustrated embodiment, the cylinder 220 fully encloses a position sensing and feedback arrangement, which is embodied as a non-contacting magnetic transducer. More specifically, the cylinder 220 includes a magnetic, micro-pulse linear transducer 332 that is mounted on the cylinder cap or leader block 314. The transducer 332 includes a sensing rod 334 that is connected to a sensor housing 316 and extends into the bore 302 of the housing 208 concentrically relative to the rod 210. The rod 210 has a blind bore 335 extending therethrough in aligned relation to the sensing rod 334 and at a clearance therewith such that the rod 210 can move relative to the housing 208 as previously described without interfering with the sensing rod 334. Micropulse linear transducers are available in a number of resolutions from 0.002 to 0.1 mm. In the illustrated embodiment, a micropulse linear transducer having a 0.04 mm resolution is utilized, which during operation of the machine 200 provides a non-linearity specification of plus or minus 0.08 mm and a repeatability specification of plus or minus 0.08 mm.

Use of the micropulse linear transducer 332 provides a positioning accuracy potential that is at least six times better than can be expected with a string transducer. Micropulse linear transducers are also known as magneto-restrictive linear position sensors. The position data from such transducers represents the absolute distance between a magnet and the head end of the measuring rod 334. To achieve this arrangement, a magnet 340 is mounted in a bore 344 formed at the inner end 318 of the rod 210. The magnet 340 thus moves along with the rod 210 as the sensor rod 334 remains connected to the leader block 314. Magnet 340 is sandwiched between two non-magnetic spacers 342 and 343 and held in place in bore 344 by retaining ring 345. Other contactless linear measurement devices such as one based upon an inductive principal or one based on a Hall Effect principle could be used in place of the micropulse linear transducer 332.

During operation, as the position of the rod 210 changes with respect to the leader block 314, the magnetic field created by the magnet 340 as it traverses the sensing rod 334 will change as the distance of the magnet 340 changes with respect to a stem 41 of the sensing rod. This change in magnetic field will be sensed by the transducer 332, which will continuously provide a signal indicative of the absolute position or the change in position, as appropriate, to an electronic controller that controls operation of the valve 312. In such a control arrangement, a closed loop control scheme can be implemented to more accurately and quickly command the cylinder 220 to assume a desired extension or retraction in the position of the rod 210 relative to the housing 208 and, thus, the frame 202.

Figure 5:
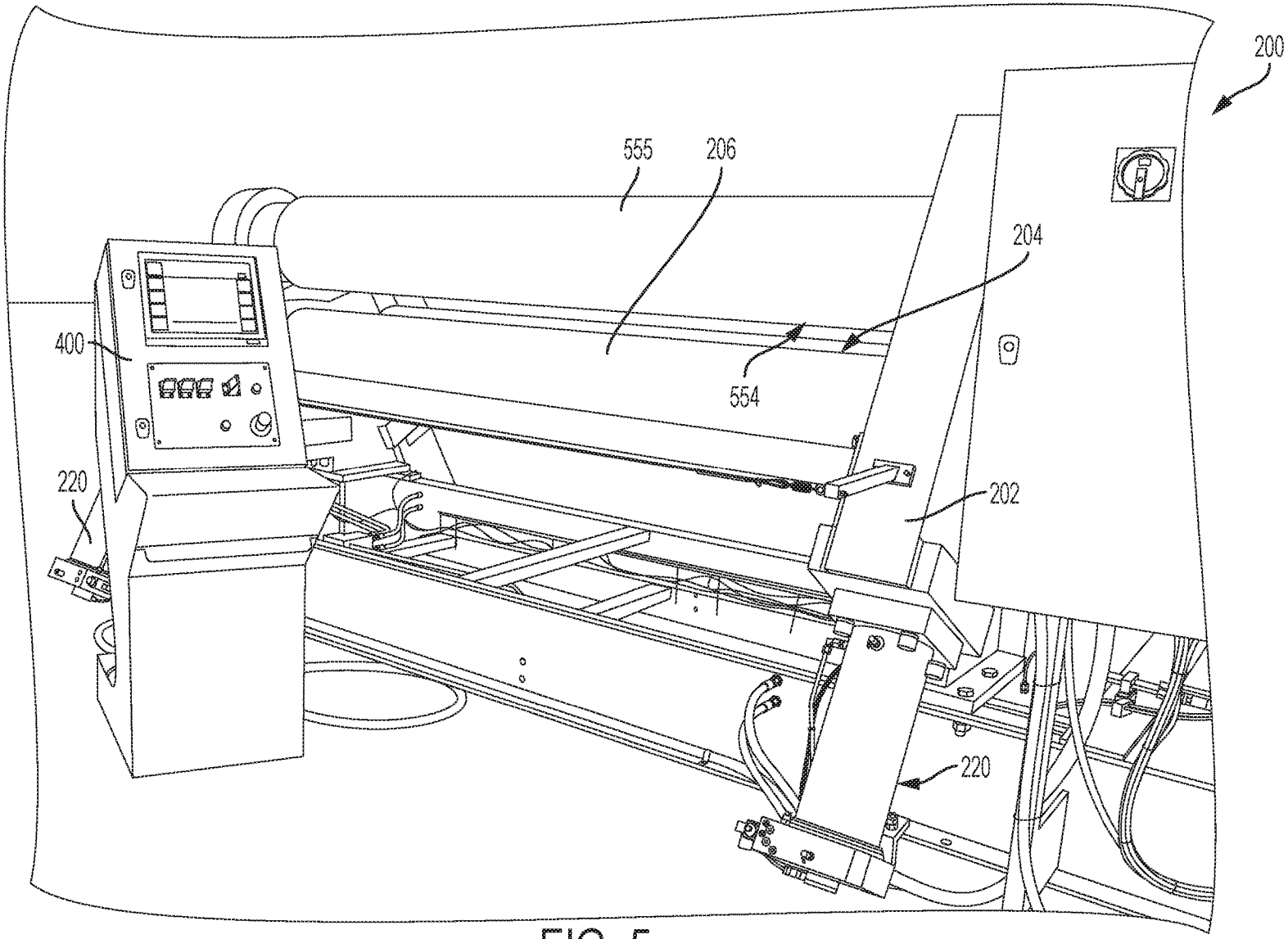
FIGS. 5 and 6 are views from different perspectives of a plate roll bending machine in accordance with the disclosure.
Figure 6:
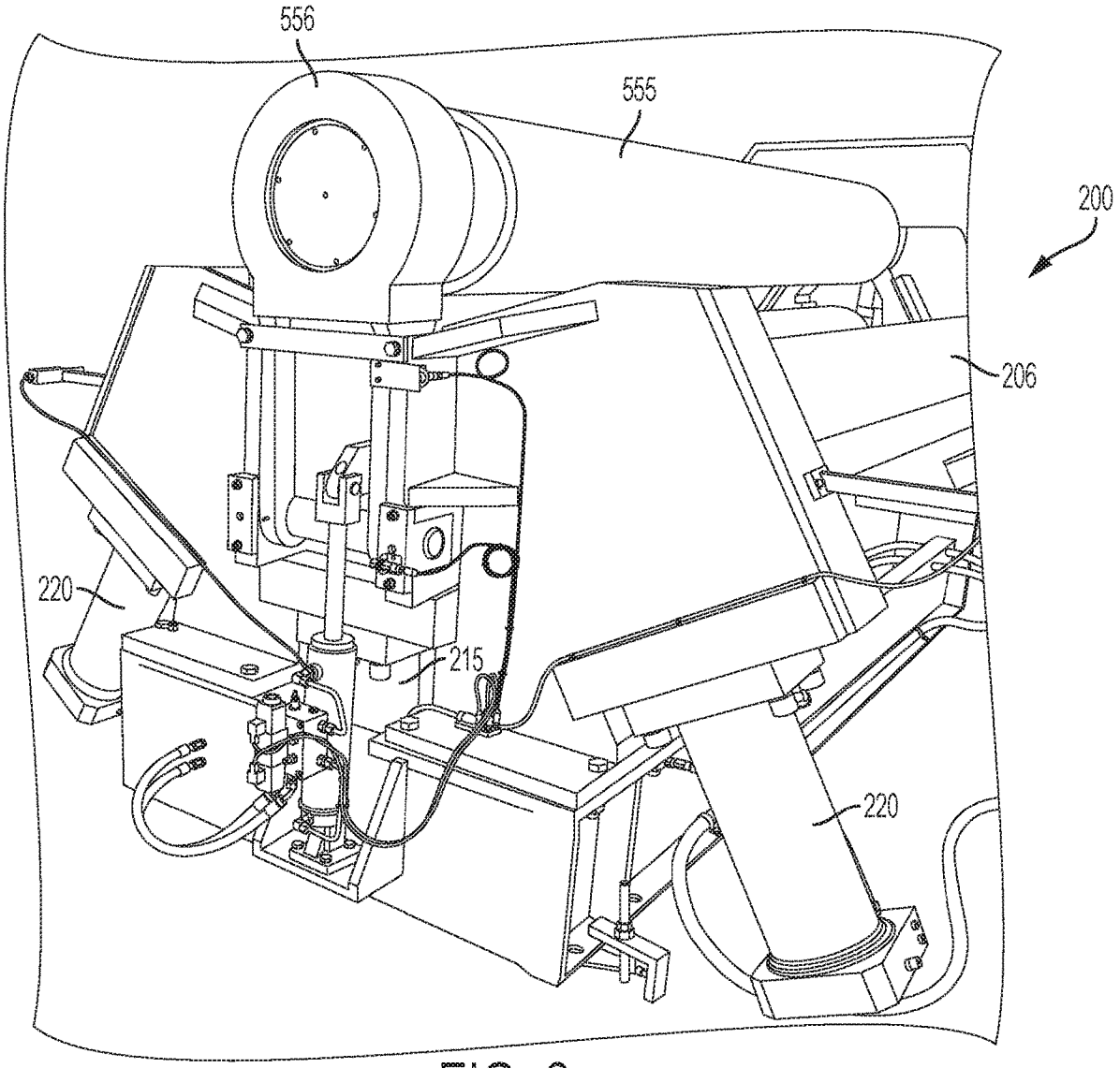

In reference now to FIGS. 5 and 6, various views and structures of the machine 200 are provided. For illustration, the machine 200 can include four rolls used for bending plates. The position of each moveable roll is adjusted by a pair of hydraulic actuator that are constructed to include an integrated position sensor similar to that of cylinder 220 shown in FIGS. 3 and 4. The various sensor signals are provided to a controller 400. The adjustable gripping roll 204 (FIG. 2) is positioned at the drive end of the machine 200 by hydraulic cylinders 215. The upper gripping roll 555 is mounted in a fixed horizontal position supported by bearings 556 allowing rotational motion. A space or slot 554 between upper gripping roll 555 and lower gripping roll 204 allows introduction of a plate for bending. Two adjustably mounted bending rolls 206 are disposed on either side of the machine 200, each having a pair of actuators 220 to adjust their height. A drive motor (not shown) operates the gripping roll 555, and a corresponding drive motor is also configured to drive the lower gripping roll 204. A hydraulic power supply unit (not shown) generates hydraulic pressure and oil flow to power the machine. Other structures and features of the machine are not shown or described for simplicity.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A hydraulic roll bending machine, comprising:

a frame;

a hydraulic cylinder having a housing forming a bore and a plunger slidably and sealably disposed within the bore of the housing, the plunger being connected to a rod extending past one end of the housing such that motion of the plunger within the bore of the housing causes the rod to extend or retract relative to the housing, wherein a first end of the hydraulic cylinder is connected to the frame;

a bending roll rotatably connected to a second end of the hydraulic cylinder such that extension or retraction of the rod changes a height of the bending roll relative to the frame;

a hydraulic system that includes a valve disposed to provide pressurized hydraulic fluid on at least one side of the plunger within the bore of the housing;

a controller operating to provide a command signal to the valve; and a sensor integrated with the hydraulic cylinder, the sensor being integrated within the bore of the housing and disposed to sense a distance of the plunger relative to one end of the housing and to provide a signal indicative of the distance to the controller; and a magnet associated with the sensor and arranged to provide a non-contacting magnetic signal to the sensor;

wherein the signal indicative of the distance is based on the non-contacting magnetic signal.

2. The hydraulic roll bending machine of claim 1, wherein the magnet is associated with one end of the rod that is connected to the plunger; and a sensing rod is connected at one end of the housing that is proximate the one end of the rod when the rod is in a retracted position;

wherein the sensor is configured to transduce a distance of the magnetic field generated by the magnet relative to the sensing rod into the signal provided to the controller.

3. The hydraulic roll bending machine of claim 2, wherein the sensing rod extends concentrically along the bore of the housing with the rod.

4. The hydraulic roll bending machine of claim 3, wherein the rod forms a blind bore extending from one end thereof, and wherein the sensing rod is disposed at least partially within the blind bore when the rod is in the retracted position.

5. The hydraulic roll bending machine of claim 4, wherein the blind bore has a clearance fit relative to the sensing rod such that the sensing rod is clear of the rod as the rod moves within the housing.

6. The hydraulic roll bending machine of claim 1, wherein the sensor has a measuring resolution less than 0.5 mm.

7. The hydraulic roll bending machine of claim 1, wherein the sensor is a micropulse linear transducer.

8. The hydraulic roll bending machine of claim 1, further comprising a second hydraulic cylinder rotatably supporting a second end of the bending roll on the frame.

9. The hydraulic roll bending machine of claim 1, wherein the sensor operates based on an inductive principal.

10. The hydraulic roll bending machine of claim 1, wherein the sensor operates based on a Hall Effect principal.

11. A hydraulic roll bending machine for bending metal plates, comprising:

a controller;

upper and lower gripping rolls rotatably and drivably mounted on a frame, wherein a plate to be bent is arranged to pass between the upper and lower gripping rolls, and wherein a height of at least one of the upper and lower gripping rolls relative to the frame is adjustable by two cylinders;

a bending roll rotatably mounted on the frame through two additional cylinders operating to adjust a height of first and second ends of the bending roll relative to the frame independently and in response to command signals provided by the controller;

wherein the controller is programmed and operates to adjust a position of each of the two cylinders and the two additional cylinders independently and based on a respective position signal provided by a respective sensor disposed in each of the two cylinders and the two additional cylinders; and wherein each respective position signal is provided by each respective sensor having sensing elements that are entirely disposed within the respective one of the two cylinders and the two additional cylinders.

12. The hydraulic roll bending machine of claim 11, wherein both the upper and lower gripping rolls are connected to drive motors for rotation.

13. The hydraulic roll bending machine of claim 11, wherein each of the two cylinders and the two additional cylinders includes a housing forming a bore and a plunger slidably and sealably disposed within the bore of the housing, the plunger being connected to a rod extending past one end of the housing such that motion of the plunger within the bore of the housing causes the rod to extend or retract relative to the housing, wherein a first end of the cylinder is connected to the frame and a second end of the cylinder rotatably supports a corresponding end of a roller.

14. The hydraulic roll bending machine of claim 13, wherein each cylinder includes a sensor, each sensor comprising:

a magnet associated with one end of the rod that is connected to the plunger; and a sensing rod connected at one of the housing that is proximate the one end of the rod when the rod is in a retracted position;

wherein the sensor is configured to transduce a distance of the magnetic field generated by the magnet relative to the sensing rod into the signal provided to the controller.

15. The hydraulic roll bending machine of claim 14, wherein the sensing rod extends concentrically along the bore of the housing with the rod.

16. The hydraulic roll bending machine of claim 15, wherein the rod forms a blind bore extending from one end thereof, and wherein the sensing rod is disposed at least partially within the blind bore when the rod is in the retracted position.

17. The hydraulic roll bending machine of claim 16, wherein the blind bore has a clearance fit relative to the sensing rod such that the sensing rod is clear of the rod as the rod moves within the housing.

18. The hydraulic roll bending machine of claim 11, wherein the sensor has a measuring resolution less than 0.5 mm.

19. The hydraulic roll bending machine of claim 11, wherein the sensor is one of a micropulse linear transducer, an inductive sensor and a Hall Effect sensor.

20. The hydraulic roll bending machine of claim 11, further comprising a second hydraulic cylinder rotatably supporting a second end of each of the upper and lower gripping rolls and the bending roll.

* * * * *